United States Patent [19]

Holder et al.

[11] Patent Number: 4,829,793

[45] Date of Patent: May 16, 1989

[54] ULTRA UNIFORM FLUID APPLICATION APPARATUS

[75] Inventors: Joseph P. Holder, Greensboro; Michael I. Glenn, Burlington; Bobby L. McConnell; Louis A. Graham, both of Greensboro, all of N.C.

[73] Assignee: Burlington Industries, Inc., Greensboro, N.C.

[21] Appl. No.: 137,742

[22] Filed: Dec. 24, 1987

Related U.S. Application Data

[60] Continuation-in-part of Ser. No. 21,358, Mar. 3, 1987, which is a continuation-in-part of Ser. No. 908,289, Sep. 16, 1986, which is a division of Ser. No. 729,412, May 1, 1985, Pat. No. 4,650,694.

[51] Int. Cl.[4] ..... D06B 1/02

[52] U.S. Cl. ..... 68/205 R; 118/315; 118/674

[58] Field of Search ..... 68/200, 205 R; 118/315, 118/674

[56] References Cited

U.S. PATENT DOCUMENTS

| | | | |
|---|---|---|---|
| 3,402,695 | 9/1968 | Baker et al. | 118/674 |
| 3,717,722 | 2/1973 | Messner | 118/624 X |
| 4,254,644 | 3/1981 | Bartlett et al. | 68/205 R |
| 4,431,690 | 2/1984 | Matt et al. | 118/674 X |
| 4,530,862 | 7/1985 | Kerzel | 118/674 X |
| 4,665,723 | 5/1987 | Zimmer | 68/200 |

*Primary Examiner*—Philip R. Coe

*Attorney, Agent, or Firm*—Nixon & Vanderhye

[57] ABSTRACT

A fluid jet applicator is disclosed which senses orifice plate fluid pressure and the fabric substrate speed and electronically controls the flow of fluid by modulating fluid pressure in accordance with the speed and characteristics of the fabric substrate. In this fashion, a highly uniform solid shade is applied across the width of the fabric. The uniformity of the applied solid shade is limited only by the uniformity of the orifices in the applicator orifice plate. Additionally, by operating at higher fluid pressures than electrostatic fluid jet applicators, the present invention is significantly more productive than such electrostatic applicators.

17 Claims, 3 Drawing Sheets

ULTRA UNIFORM FLUID APPLICATION APPARATUS

CROSS REFERENCE TO RELATED APPLICATION

This invention is a continuation-in-part of copending commonly assigned application Ser. No. 021,358, filed Mar. 3, 1987, which is a continuation-in-part of application Ser. No. 908,289, filed Sept. 16, 1986, which is a division of Ser. No. 729,412, filed May 1, 1985, now U.S. Pat. No. 4,650,694.

FIELD OF THE INVENTION

The invention relates to an improved method and apparatus for achieving uniform application of liquids onto substrate surfaces with a fluid jet applicator having a linear orifice array at significantly increased production rates. The invention is particularly useful in the textile industry for uniformly applying, for example, liquid dye to provide color or shade solidity (i.e., uniformity of treatment by the dyestuff) throughout the surface and depth of a treated fabric substrate.

BACKGROUND AND SUMMARY OF THE INVENTION

It is highly desirable to achieve fairly tight control over the amount of fluid that is actually applied to a textile in a given treating process (e.g., dyeing). In many conventional textile liquid treatment processes, such control is not practically possible, i.e., a considerable amount of excess "add-on" liquid is necessarily applied to the textile. Subsequently, much effort and expense are typically encountered in removing this excess fluid. In this regard, some of the excess fluid might be physically squeezed out of the textile, for example, by passage through opposed rollers or pads.

Although some of the excess fluid is physically squeezed out with such conventional processes, most of it will have to be evaporated by heated air flows or the like. This not only requires considerable investment of equipment, energy, time and real estate, it also often produces a contaminated flowing volume of air which must be further treated before it is ecologically safe for discharge. In addition, there is an obvious loss of the sometimes precious treating material itself—unless it is somehow recaptured and recycled which in itself involves yet further additional expense, effort, etc. Accordingly, by applying only the needed amount of liquid "add-on" treatment to a fabric, there is considerable economic advantage to be had.

The solid shades produced by such conventional processes are uniform only to a limited extent. A close inspection of textiles treated by such processes reveals variations in the solid shade across the fabric width. The lack of uniformity results from the pressure differential applied across the fabric width by the above mentioned rollers or pads. Such pressure differential may, for example, cause the fabric center to be darker than the two ends.

In many textile dyeing applications, the treating liquid must be uniformly distributed throughout the treated substrate if one is to achieve a commercially acceptable product. Furthermore, in typical commercial environments, it is necessary for a single apparatus to successfully treat a wide variety of different types of textile substrates each having different requirements if uniformity is to be achieved.

For example, if a fluid jet applicator is used for solid shade dyeing in textile applications, the fluid jet applicator must be able to apply fluid in a uniform fashion to an entire range of commercial fabrics. Different styles of fabric vary considerably in terms of fiber content, construction, weave and preparation. These general parameters, when combined, in turn determine relative physical properties and characteristics of a given fabric such as porosity, weight, wetability, capillary diffusion (wicking) and the like. As will be appreciated, the volume of fluid per unit surface area required to adequately treat a given fabric is greatly influenced by these physical properties.

Electrostatically controlled fluid jet applicators, such as the applicator described in the aforementioned application Ser. No. 729,412, now U.S. Pat. No. 4,650,694, are capable of applying solid shades to fabric substrates with a uniformity much greater than the aforementioned conventional textile treating processes. Such electrostatic applicators, while furnishing a degree of precision never before approached in textile processing, are not without their limitations. For example, such applicators are designed to deliver fluid from the orifice array within a very limited operating fluid pressure range. Although the specific pressure range in a given applicator may vary depending on the size of the orifices in the array, the fluid pressure for such an applicator may, for example, be in a range of 3.5 to 4.5 p.s.i.

In such electrostatic applicators, once an optimum fluid pressure of a particular orifice array is determined, the fluid pressure level is maintained at this pressure level. In this manner, a breakup length for the droplets is provided which insures that the droplet breakup occurs while the droplet is directly opposed to the charging electrode (which is on the order of 0.375 inches in length).

If the fluid pressure of an electrostatic applicator is increased to a level exceeding the above-mentioned optimum pressure, the droplet breakup length will be longer and the droplets will break up outside the charging area and will therefore, not be properly charged. Accordingly, in such electrostatic applicators, the conventional wisdom is that the maximum amount of fluid which may be placed on a substrate is limited to the volume of fluid which can be dispensed at the maximum fluid pressure for which droplet breakup would occur in the charging region.

Turning to a specific example of operation with an electrostatic fluid jet applicator, if a particular fabric weighs 5 oz. per square yard, it would typically require, in order to dye the fabric to a solid shade, 50 % wet add-on to achieve the desired uniformity of solid shade. References herein to maintaining uniform coverage should be understood to include maintenance of a selected wet add-on. Given the maximum fixed fluid pressure of, for example, 4 p.s.i, to uniformly cover the 5 oz. per square yard of fabric with the 50% wet add-on requirement, the maximum speed for moving the substrate may, for example, be 50 yards per minute.

At this rate, the maximum amount of fluid is required out of the jet applicator to uniformly cover the fabric. This is called the "full flow" condition and is the practical limit of speed for a particular electrostatically controlled fluid applicator which is operating at a fixed fluid pressure to uniformly cover a particular fabric. When the "full flow" condition is reached, all of the fluid being delivered through the orifice plate at a fixed fluid pressure is required by the substrate to maintain uniform coverage. The normal operation of electrostatically controlled fluid jet applicators is typically at or below this full flow condition. Accordingly, the need for an electrostatic applicator to operate in a very limited fluid pressure range, limits the production rates achievable by an electrostatic applicator.

Additionally, electrostatic applicators have a number of limitations associated with the electrostatic charging and deflecting subsystem and the circuitry associated therewith. In this regard, electrostatic applicators have problems relating to lint collecting on the electrodes and electrical shorts which develop when a jet goes out of alignment and fluid is inadvertently sprayed on an electrode. Such a short will cause a defect in the fabric by producing a dark mark or a line on the fabric.

Electrostatic applicators are further limited as to the fluids that they are capable of handling. In this regard, electrostatic applicators must operate with a fluid of a suitable conductivity and viscosity so that a droplet breakup length is provided to ensure appropriate droplet charging. Additionally, the fluids used in such applications must be restricted to those fluids which can be exposed to air, electrostatically diverted into a catcher, and then recirculated into the fluid dye tank. Certain fluids upon contact with air change their chemical constituency so that they would not be suitable for use when recirculated. Such fluids would not be suitable for use in an electrostatic fluid jet applicator.

As noted above, electrostatically controlled fluid jet applicators deliver a high degree of solid shade uniformity across the width of the fabric. The uniformity, however, is limited to at least a slight degree by the electrostatic fields created in such a machine and the effect of such fields on the generated fluid droplets.

The present invention includes an electronically controlled fluid jet applicator which does not utilize electrostatic droplet control, but which retains certain of the high precision features associated with electrostatically controlled fluid jet applicators. The method and apparatus of the present invention is less expensive to manufacture and maintain then the aforementioned electrostatically controlled fluid jet applicators.

Additionally, the present invention does not typically incur the problems with lint and short circuits associated with the electrostatic fluid jet applicators. Advantageously, in the present invention, the operating range of the applicator may be extended well beyond the limits of the aforementioned electrostatically controlled applicator while handling fluids with viscosities, conductivities, and other properties not suitable for electrostatic droplet recirculation systems.

The fluid jet applicator of the present invention senses orifice plate fluid pressure and fabric substrate speed and electronically controls the flow of fluid by modulating fluid pressure in accordance with the speed and characteristics of the fabric substrate. In this fashion, a highly uniform solid shade may be applied across the width of the fabric. The uniformity of the applied solid shade is limited only by the uniformity of the orifices in the orifice plate used in the applicator. Additionally, by operating at higher fluid pressures than electrostatic fluid jet applicators, the apparatus of the present invention is significantly more productive than such electrostatic applicators.

BRIEF DESCRIPTION OF THE-DRAWINGS

These as well as other objects and advantages of this invention will be better appreciated by reading the following detailed description of the presently preferred exemplary embodiment taken in conjunction with the accompanying drawings, of which:

DETAILED DESCRIPTION OF THE INVENTION

Figure 1:
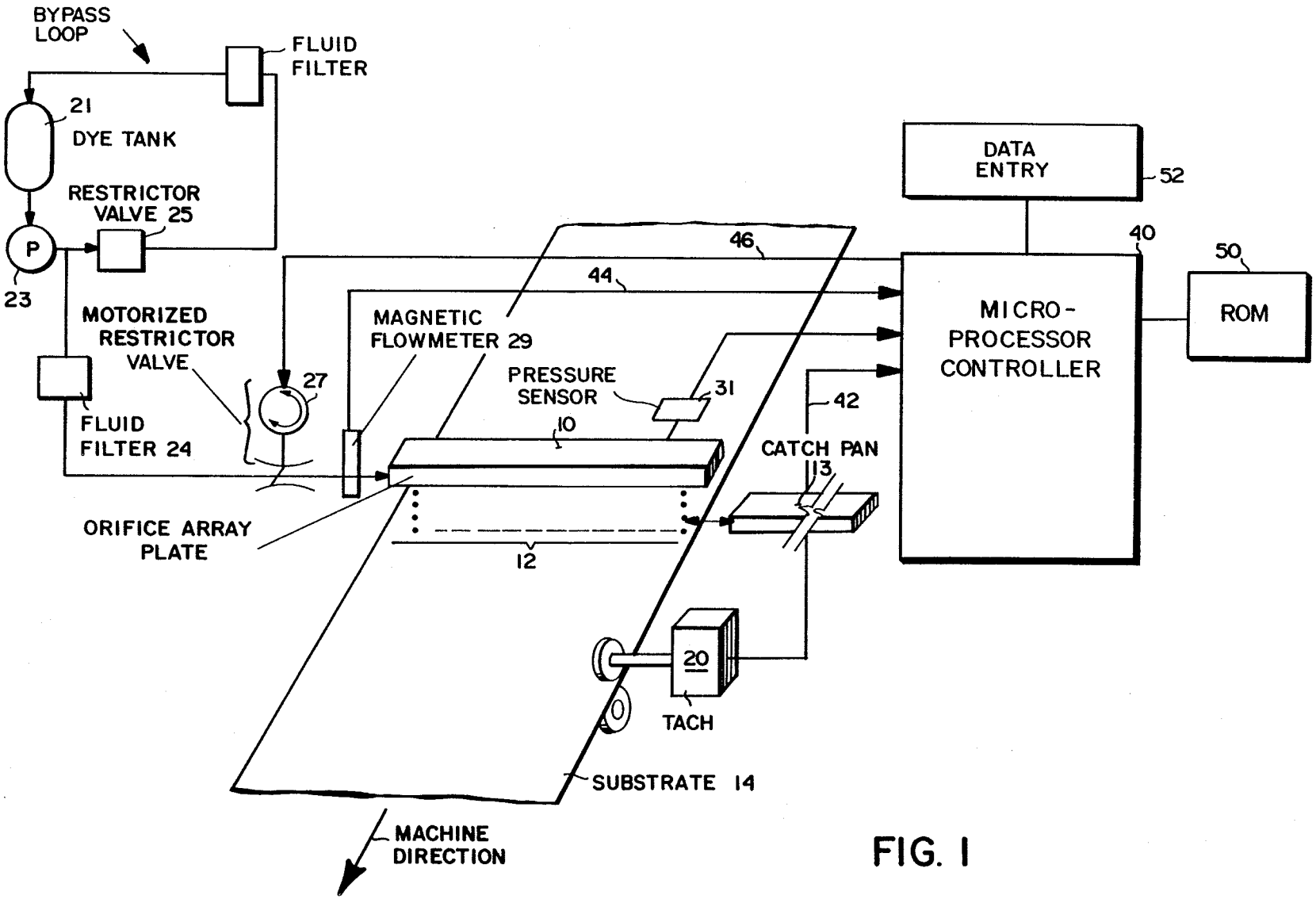
FIG. 1 is a schematic depiction of an exemplary fluid jet applicator in accordance with the present invention.

An exemplary fluid jet applicator according to the present invention is depicted in FIG. 1. The fluid jet applicator includes a random droplet generator 10 which is comprised of a fluid plenum and a linear array of jet orifices in a single orifice array plate. In contrast to typical electrostatic applicators, droplet generator 10 employs no artificial stimulation. The orifice plate is preferably of the type disclosed in U.S. Pat. No. 4,528,070. The jet orifices are disposed to emit parallel liquid streams which break into corresponding parallel lines of droplets 12 falling downwardly onto the surface of a fabric containing substrate 14 moving in the machine direction (as indicated by the arrow) transverse to the linear orifice array. Thus, as will be explained further below, unless catch pan 13 is interposed between the orifice plate and the fabric substrate, all droplets leaving the orifice plate will reach the substrate.

Associated with the droplet generator 10 is a suitable fluid supply such as dye tank 21. As shown in FIG. 1, pump 23 provides the pressure to draw fluid from the bottom of dye tank 21 through a filter (not shown). By way of example only, pump 23 may be implemented by two magnetically coupled gear pumps Models TMM-1078 and TMM-1079 manufactured by Tuthill Pump Company. The pumps may be mounted on a single Baldor 5Hp, 3 phase, 230–480 volt motor, where one pump is turning clockwise and the other counter-clockwise.

A restrictor valve 25 on the output side of pump 23 is set to maintain, for example, a 15 p.s.i. head pressure (as determined by pressure sensors in the recirculation line) and allows excess fluid to return to the dye tank 21 while maintaining a constant head pressure downstream. Fine pressure regulation of the fluid supplied to the orifice plate is achieved by a motorized valve 27. The motorized valve 27, which receives fluid via filter 24, may be, for example, a Chemtrol electrically actuated valve MAR-8-8-4, ½ inch. The restrictor valve 25 insures that a greater back pressure is always available at valve 27 then will be needed to properly control the applicator. The motorized valve 27 will be activated by controller 40 to deliver the desired fluid pressure. As will be explained in detail below, controller 40 monitors the pressure at the orifice plate via pressure sensor 31 and corrects for pressure changes due, for example, to the loading of filters (such as filter 24). A flow meter 29 is disposed between restrictor valve 27 and the fluid plenum to provide controller 40 with an indication of the current flow rate.

In the exemplary embodiment of FIG. 1, a tachometer 20 is mechanically coupled to substrate 14. For example, one of the driven rollers of a transport device (not shown) used to cause substrate motion (or merely a follower wheel or the like) may drive the tachometer 20. In the exemplary embodiment, the tachometer 20 may comprise a Litton brand shaft encoder Model No. 74BI1OOO-1 and may be driven by a 3.125 inch diameter tachometer wheel so as to produce one signal pulse at its output for every 0.010 inch of substrate motion in the longitudinal or machine direction. It will be appreciated that such signals will also occur at regular time intervals provided that the substrate velocity remains at a constant value.. Accordingly, if a substrate is always moved at an approximately constant value, then a time driven clock or the like possibly may be substituted for the tachometer 20 as will be appreciated by those in the art.

The tachometer 20 is coupled via line 42 to microprocessor controller 40. Microprocessor controller 40, which, by way of example only, may be an Intel 8080 is coupled to a read only memory (ROM) 50 and a data entry keyboard/display device 52. Microprocessor controller 40, in a manner which will be explained in detail below in conjunction with FIG. 3, monitors the fluid jet applicator's operation and controls fluid flow by regulating the orifice fluid pressure. In this regard, upon sensing the tachometer output on line 42 and the current fluid pressure via line 31, the motorized restrictor valve 27 is controlled via line 46 to drive the fluid to the orifice array at, for example, an increased pressure. The fabric substrate is thereafter controlled by a fabric drive system (not shown) to move at a faster rate while maintaining the same add-on level to maintain uniform fabric coverage. Thus, the controller 40 controls the fluid pressure such that as the substrate speed is increased (as sensed by tachometer 20), the fluid pressure will be increased so that uniform fabric coverage will result. The fluid pressure must be continuously adjusted via signals from controller 40 via line 46 as the speed of the line changes.

Changes in fluid pressure will not be as quickly responsive to control signals received by the motorized restrictor valve 27 when compared to the rate at which the substrate 14 speed may be changed. In this regard, the speed at which mechanical elements, such as valve 27, respond to control signals requesting a pressure change, is not as fast as the electronically controlled speed modifying elements in the substrate drive system. Accordingly, the pump pressure may have to be initially raised more sharply to compensate for this difference in response time. Alternatively, the rate of substrate speed may have to be slowed to agree with the response time of fluid pressure regulation.

Figure 3:
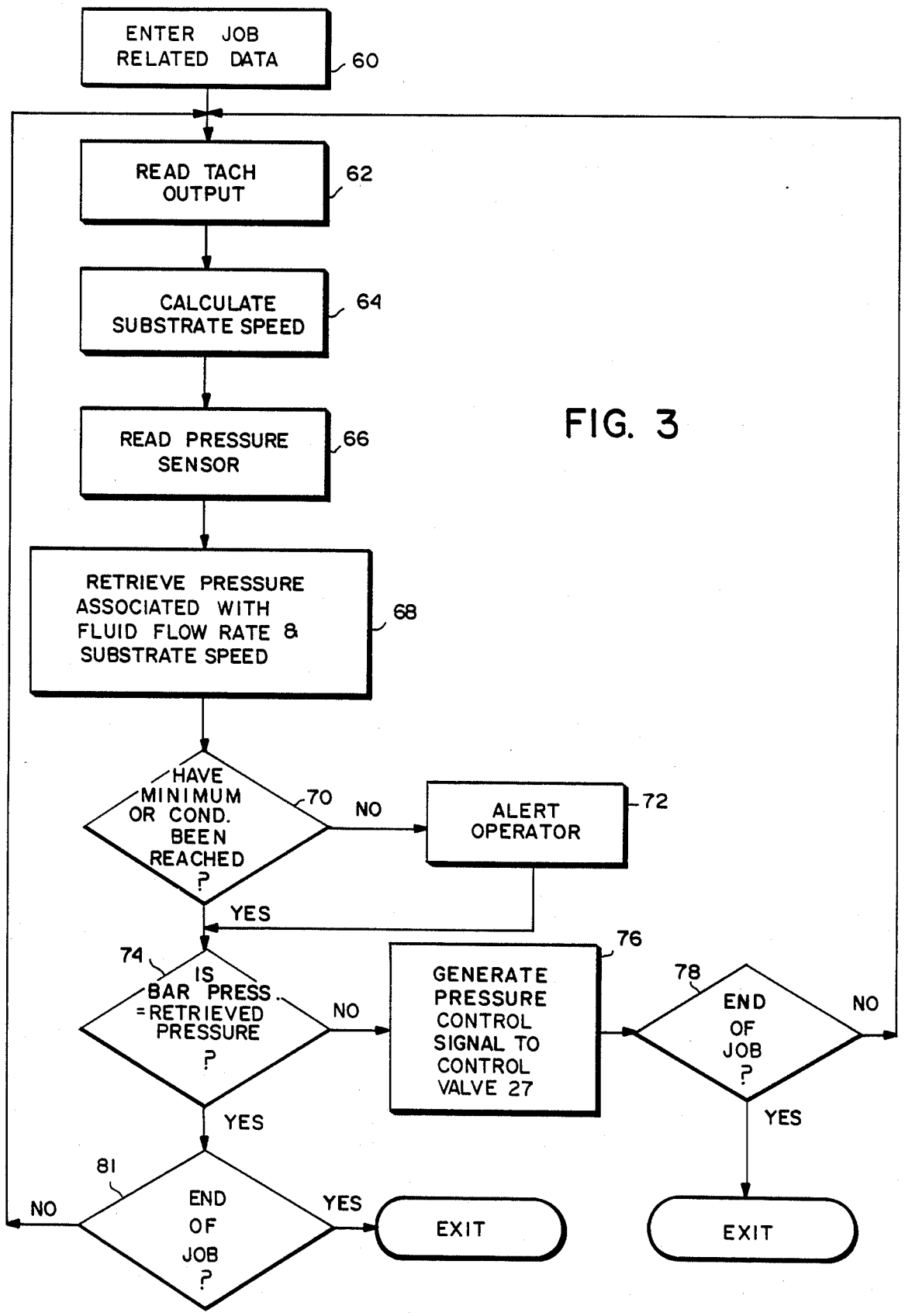
FIG. 3 is a flowchart which depicts the sequence of operations performed by controller 40 in accordance with the present invention.

In operation, as shown by the flowchart in FIG. 3, an operator initially enters job related data via data entry terminal 52 (60). For example, fabric designation indicia, fabric weight and desired liquid add-on, orifice plate flow factor (i.e., an adjustment factor, for example, to compensate for small variations in orifice sizes and fluid flow rates for a particular orifice plate) may be entered by an operator. As an alternative to entering such detailed information regarding the fabric substrate, an operator may calculate off line (based on fabric weight and the desired liquid add-on), the amount of fluid per square yard needed. Then, presuming that an orifice plate flow factor had previously been entered for the orifice plate in use, the operator would enter a flow rate calculated to achieve the desired wet pick up for the fabric substrate being processed.

The precise correlation between fabric speed and the pressure increases necessary to achieve a fluid flow rate may readily determined empirically. This correlated data would be stored in ROM 50 of FIG. 1. The relationship between substrate throughput speed and pressure may have to be tailored to each specific fluid bar design in order to take into account variations in volumes and elasticity of components. Moreover, as will be recognized by those skilled in the art, the amount of fluid to be placed on a given fabric is a function of the weight of the fabric, the fabric absorbency and construction.

Figure 2:
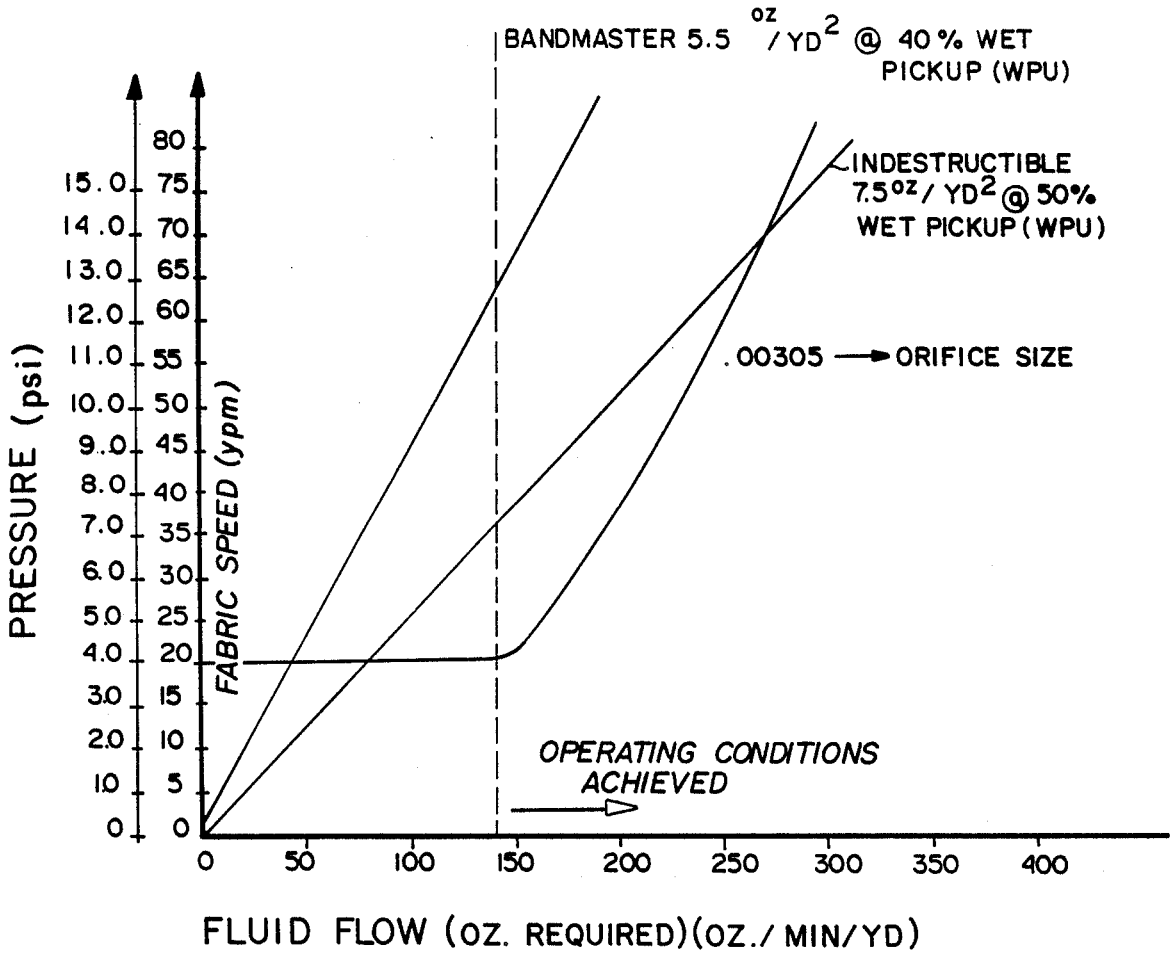
FIG. 2 is a graph of empirical data showing the observed relationship between fabric speed and fluid flow correlated with orifice fluid pressure.

FIG. 2 shows a graph which illustrates the data relating to the wet pick up requirements for two fabrics referred to as "Bandmaster" and "Industructible". The graph plots the fabric speed in yards per minute as a function of fluid flow in ounces per minute per yard. As shown by the graph, the fabric speed and the fluid flow required to achieve the desired wet pick up are linearly related.

Superimposed on the graph is an empirically obtained line indicating the relationship between pressure and fluid flow for a fluid bar having 0.00305 inch orifice diameters. The dotted line shown on the graph delineates the minimum fluid pressure required to achieve the fluid flow rate necessary for achieving optimum operating conditions. In this regard, the precision of the applicator of the present invention is achieved only when the speed of the substrate and the fluid pressure are level. Based on the sensed speed, the applicator controls the fluid pressure to deliver a fluid flow to the substrate to achieve a particular wet pickup. During a predetermined starting period before operating conditions are reached which will generate the desired wet pickup, the catch pan 13 is used to prevent the droplet curtain from reaching the substrate. Upon reaching operating conditions, the microprocessor controller 40 will generate a signal indicating that the catch pan 13 may be manually moved by the operator. Alternatively, the controller 40 may generate a control signal to initiate the automatic removal of the catch pan by an electromechanical transporting mechanism (not shown).

Focusing on the data shown in FIG. 2, for the fabric Indestructible at a fabric speed of 55 yards per minute, the data shows that it would be necessary to achieve a fluid flow rate of approximately 210 ounces per minute per yard to achieve the required uniform coverage. Moreover, according to FIG. 2, to achieve a flow rate of 210 ounces per minute per yard, a pressure of approximately 8.6 p.s.i. would be required. Such data for this and other points on the graph would be stored in ROM 50.

Turning back to the flowchart of FIG. 3, after the operator has entered job related data (60) as described above, the controller 40 reads the tachometer output from line 42 of FIG. 1 (62) and calculates the instantaneous substrate speed (64). Thereafter, controller 40 reads the fluid pressure from pressure sensor 31 (66). Based on the entered data, an the sensed speed, the controller accesses the table stored in ROM 52 to retrieve the fluid pressure associated therewith (68).

Thereafter, controller 40 checks to determine whether the minimum operating conditions have been achieved for uniform solid shade applications (70) (e.g., note the minimum fluid pressure and the minimum substrate speed shown in FIG. 2). If the minimum conditions have not been reached, the operator is alerted (72). Until such minimum operating conditions are reached, the emergency catch pan 13 should be interposed between the orifice plate and the substrate. As noted above, after the minimum conditions have been reached, the catch pan is either manually or automatically moved.

After a minimum operating condition check has been made (whether or not the minimum operating conditions have been met), the sensed fluid pressure is compared with the retrieved fluid pressure from ROM 52 (74). If the current bar pressure does not equal the retrieved pressure, then a pressure control signal is generated which is transmitted by controller 40 on line 46 to motorized valve 27 which controls the bar pressure to rise or fall to match the retrieved pressure (76). Thereafter, an end of job check is made at 78. If the end of the job has not been reached, the routine returns to block 62 and the speed and pressure are repetitively sensed as described above. If the test at block 74 indicates that the current bar pressure equals the retrieved pressure, an end of job check is made at block 81 and the routine branches back to block 62 if the job is not yet complete. If the end of job tests at blocks 78 or 81 indicate that the job is complete, the routine is exited.

As will be appreciated by those skilled in the art, the present invention likewise contemplates that the relationship between fluid flow rate and fluid pressure may be mathematically modeled by an equation which defines the curve representing the empirically obtained data. Thus, instead of storing a table in ROM 52 correlating such data, it is contemplated that an equation mathematically defining the pressure curve shown in FIG. 2 may be obtained using conventional mathematical curve fitting techniques. Thereafter, the required fluid pressure may be calculated using such an equation rather than being obtained by table lookup techniques.

The present invention further contemplates additional feedback controls for ensuring the accuracy of the present system by utilizing a fluid flow meter downstream of the pressure controlling valve 27 as shown in FIG. 1. In this regard, the flow meter may be a conventional magnetic flow meter which is highly accurate and which will not introduce protuberances into the fluid flow.

Such a flow meter may, for example, be used after controller 40 sets pressure controlling valve 27 to the desired value. Instead of the system merely assuming that the flow rate will be set as desired, the flow meter may be used to ensure that the actual fluid flow reaches the desired rate. If the desired flow rate is not achieved, then the controller 40 will reset valve 27 accordingly.

The degree of solid shade uniformity across the width of a fabric substrate is significantly enhanced by the present invention when compared with conventional textile treating processes. In fact, the present invention provides an improvement over the electrostatically controlled fluid jet applicators referred to above since there is no interaction of charge and deflection electronics on the fluid in the present invention. In practical terms, the sole limiting factor in the present invention as to solid shade uniformity is the degree of uniformity in the orifice plate used in the applicator (e.g., see orifice plate shown in U.S. Pat. No. 4,528,070). In fact, studies have shown that the degree of uniformity achievable by the present invention is within a range of plus or minus 1 ½% over the 1.8 meter length of the presently preferred orifice plate. Additionally, besides achieving significantly enhanced uniformity, the present invention due to its increased fluid pressure and associated substrate speed serves to significantly increase production rates over electrostatic applicators.

While the present invention has been described in terms of its presently preferred form, it is not intended that the invention be limited only by the described embodiment. It will be apparent to those skilled in the art that many modifications may be made which nevertheless lie within the spirit intended scope of the invention as described in the claims which follow:

What is claimed is:

1. A fluid jet applicator for uniformly applying fluid from a fluid source to a substrate movable along a predetermined path, said fluid jet applicator comprising:

an orifice plate having a linear array of orifices extending transversely to said predetermined path, said orifice plate including in the range of 50 to 150 orifices per inch;

a manifold for receiving fluid from said fluid source and for distributing said fluid to said orifice plate;

regulator means for regulating the pressure of the fluid fed to said orifice plate; and control means coupled to said regulator means and responsive to the speed of said substrate and data relating to tee characteristics of the substrate to control the uniform application of fluid to said substrate by regulating the pressure of the fluid fed to said orifice plate.

2. A fluid jet applicator according to claim 1, wherein said control means includes data processing means for providing pressure control signals to said regulator means for modulating the fluid pressure received at said array of orifices in accordance with the fluid flow rate required at a predetermined substrate speed to achieve a uniform application of fluid to said substrate.

3. A fluid jet applicator according to claim 2, further including means for generating substrate speed indicating signals; and means for coupling said substrate speed indicating signals to said data processing means.

4. A fluid jet applicator according to claim 2, further including means for sensing the pressure of fluid being fed to said orifice array and for transmitting a signal indicative thereof to said data processing means.

5. A fluid jet applicator according to claim 2, wherein said data processing means includes memory means for storing fluid flow rates and associated fluid pressures for a predetermined orifice array.

6. A fluid jet applicator according to claim 5, wherein said data processing means further includes means responsive to predetermined fluid jet applicator operating conditions for retrieving from said memory means the fluid pressure required to uniformly apply fluid to a substrate having predetermined characteristics.

7. A fluid jet applicator according to claim 1, further including means disposed between said regulator means and said manifold for measuring the fluid flow rate of the fluid being fed to said orifice array and for transmitting a signal indicative thereof to said control means.

8. A fluid jet applicator according to claim 7, wherein said control means includes feedback means responsive to said fluid flow rate indicating signal for controlling said pressure regulator means if said signal indicates that the actual flow rate does not match the desired flow rate.

9. A fluid jet applicator according to claim 7, wherein said means for measuring flow is a magnetic flow meter.

10. A fluid jet applicator according to claim 1, wherein said control means includes data entry means for entering substrate characteristic related data.

11. A fluid jet applicator according to claim 10, wherein said substrate related characteristic data includes desired liquid add-on indicia.

12. A fluid jet applicator according to claim 10, wherein said data entry means includes means for entering an adjustment factor relating to the flow rate of the particular orifice plate in use.

13. A fluid jet applicator according to claim 1, further including a catch pan disposed between the orifice plate and said substrate during time periods when it is desired to prevent fluid from striking the substrate.

14. A fluid jet applicator according to claim 13, wherein said catch pan is disposed to prevent fluid from striking the substrate from initial start up until a predetermined substrate speed and fluid pressure has been reached.

15. A fluid jet applicator according to claim 1, further including means coupled to said fluid source for supplying fluid to said regulating means having a fluid pressure in excess of the pressure needed under normal fluid jet operating conditions.

16. A fluid jet applicator according to claim 1, wherein said orifice plate is on the order of 1.8 meters in length.

17. A fluid jet applicator according to claim 1, wherein said control means for controlling the uniform application of fluid to a substrate operates such that the variation in the uniformity of fluid application over the cross-machine width of the substrate is in the range of $1\frac{1}{2}$ to 10 percent.

* * * * *